US010538085B2

(12) United States Patent
Misumi et al.

(10) Patent No.: US 10,538,085 B2
(45) Date of Patent: Jan. 21, 2020

(54) LIQUID DISCHARGE HEAD SUBSTRATE, LIQUID DISCHARGE HEAD, AND METHOD FOR DISCONNECTING FUSE PORTION IN LIQUID DISCHARGE HEAD SUBSTRATE

(71) Applicant: CANON KABUSHIKI KAISHA, Tokyo (JP)

(72) Inventors: Yoshinori Misumi, Tokyo (JP); Yuzuru Ishida, Yokohama (JP); Maki Kato, Fuchu (JP); Takahiro Matsui, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/132,797

(22) Filed: Sep. 17, 2018

(65) Prior Publication Data

US 2019/0105898 A1 Apr. 11, 2019

(30) Foreign Application Priority Data

Oct. 6, 2017 (JP) ..... 2017-195985

(51) Int. Cl.
*B41J 2/14* (2006.01)
*B41J 2/05* (2006.01)

(52) U.S. Cl.
CPC ..... *B41J 2/14056* (2013.01); *B41J 2/05* (2013.01); *B41J 2/14112* (2013.01); *B41J 2002/14459* (2013.01)

(58) Field of Classification Search
CPC . B41J 2/14056; B41J 2/14112; B41J 2/14129
USPC ..... 347/56, 63–65, 203, 204, 206
See application file for complete search history.

(56) References Cited

U.S. PATENT DOCUMENTS 8,191,988 B2 * 6/2012 Matsui ..... B41J 2/14072 347/28
9,096,059 B2 * 8/2015 Hatsui ..... B41J 2/14112
9,833,992 B2 * 12/2017 Taniguchi ..... B41J 2/14112

FOREIGN PATENT DOCUMENTS

JP 2014-124920 A 7/2014

* cited by examiner

*Primary Examiner* — An H Do
(74) *Attorney, Agent, or Firm* — Canon USA, Inc., IP Division

(57) ABSTRACT

Influence of transform of quality to an entire liquid discharge head is suppressed when a heat resistor and a covering portion are electrically connected to each other. To address this problem, a liquid discharge head substrate includes fuse portions for respective heat resistor arrays.

10 Claims, 10 Drawing Sheets

LIQUID DISCHARGE HEAD SUBSTRATE, LIQUID DISCHARGE HEAD, AND METHOD FOR DISCONNECTING FUSE PORTION IN LIQUID DISCHARGE HEAD SUBSTRATE

BACKGROUND

Field

The present disclosure relates to a substrate for a liquid discharge head which discharges liquid, the liquid discharge head, and a method for disconnecting a fuse portion in the liquid discharge head substrate.

Description of the Related Art

In recent years, a liquid discharge apparatus which heats liquid inside of a liquid chamber by energizing a heat resistor, generating bubbles in the liquid chamber by film boiling of the liquid caused by the heat, and discharging droplets from a discharge opening by a bubble generating energy has been widely used. When recording is performed by such a liquid discharge apparatus, a physical action, such as an impact caused by cavitation generated when bubbles are generated in the liquid, when the liquid is shrunk, or when the bubbles disappear in a region on the heat resistor may be applied on the region on the heat resistor. Furthermore, when the liquid is discharged, the heat resistor is in a high temperature, and therefore, a chemical action, such as solidification and deposition of components of the liquid which are attached to a surface of the heat resistor due to thermal decomposition may be applied on the region of the heat resistor. To protect the heat resistor from the physical action or the chemical action applied to the heat resistor, a protection layer (also referred to as a "covering portion") formed by metallic material or the like may be disposed to cover the heat resistor.

The protection layer is disposed at a position in contact with the liquid. Therefore, if electric power is supplied to the protection layer, electrochemical reaction occurs between the protection layer and the liquid and a function of the protection layer may be lost in some cases. Accordingly, an insulation layer is disposed between the heat resistor and the protection layer so that a portion of the current supplied to the heat resistor is prevented from being supplied to the protection layer.

However, it is possible that a function of the insulation layer is lost for some reason, and therefore, conduction occurs since current is directly supplied to the protection layer from the heat resistor or a line. When a portion of the current to be supplied to the heat resistor is supplied to the protection layer, an electrochemical reaction occurs between the protection layer and the liquid, and therefore, quality of the protection layer may transform. If the quality of the protection layer transforms, durability of the protection layer may be degraded. Furthermore, in a case where protection layers which cover different heat resistors are electrically connected to each other, current is supplied to one of the protection layers which is different from the other protection layer in which conduction with a corresponding one of the heat resistors is generated and influence of the transform of quality may spread.

Although a configuration in which the protection layers are separated from each other is effective to avoid this influence, the configuration in which the protection layers are not separated from each other but are connected to each other may be preferable depending on a liquid discharge head. For example, in a case where kogation removal cleaning for removing kogation deposited on a protection layer is performed by dissolving the protection layer in the liquid by the electrochemical reaction, the configuration in which a plurality of protection layers are electrically connected to each other is preferable for applying a voltage to the protection layers.

Japanese Patent Laid-Open No. 2014-124920 discloses a configuration in which a plurality of protection layers are electrically connected to a common line through a breaking portion. With this configuration, in a case where current is supplied to one of the protection layers due to the occurrence of the conduction as described above, the electrical connection to the other protection layer is disconnected since the breaking portion (a fuse portion) is disconnected by the current. By this, the transform of quality of the protection layer is prevented from being widely influenced.

However, if the number of discharge ports included in a single discharge port array is large as recent liquid discharge heads, a length of a common line which connects a plurality of covering portions which are arranged along the discharge port array to one another becomes long. If the function of the insulation layer is lost for some reasons, and therefore, conduction occurs between a heat resistor and a covering portion, a fuse portion may not be securely disconnected since a resistance value of the line is high, and therefore, current to be supplied to the fuse portion becomes small depending on a position of the heat resistor in which the conduction occurs. If the fuse portion is not disconnected, current is supplied to other covering portions from the covering portion in which the conduction occurs, and therefore, influence of the transform of quality of the covering portion may spread as an entire head. Specifically, degradation of durability of the covering portion may spread in the head.

SUMMARY

The present disclosure is provided to suppress influence of transform of quality to an entire liquid discharge head when conduction occurs between a heat resistor and a covering portion. According to an aspect of the present disclosure, a liquid discharge head substrate includes a first heat resistor array including a plurality of heat resistors, a second heat resistor array including a plurality of heat resistors which are arranged along the first heat resistor array, a plurality of first covering portions which have conductivity and which cover the respective heat resistors included in the first heat resistor array, a plurality of second covering portions which have conductivity and which cover the respective heat resistors included in the second heat resistor array, a first common line which is electrically connected to the plurality of first covering portions and which extends in a direction of the first heat resistor array, a second common line which is electrically connected to the plurality of second covering portions and which extends in a direction of the second heat resistor array, a third common line which is electrically connected to the first and second common lines. The first covering portions are insulated from the heat resistors covered by the first covering portions, and the second covering portions are insulated from the heat resistors covered by the second covering portions. The liquid discharge head substrate further includes a first fuse portion which connects an end portion of the first common line in the direction of the first heat resistor array to the third common line, and a second fuse portion which connects an end portion of the second common line in the direction of the second heat resistor array to the third common line.

Further features of the present invention will become apparent from the following description of exemplary embodiments with reference to the attached drawings.

DESCRIPTION OF THE EMBODIMENTS

First Embodiment

Liquid Discharge Head Unit

Figure 1A:
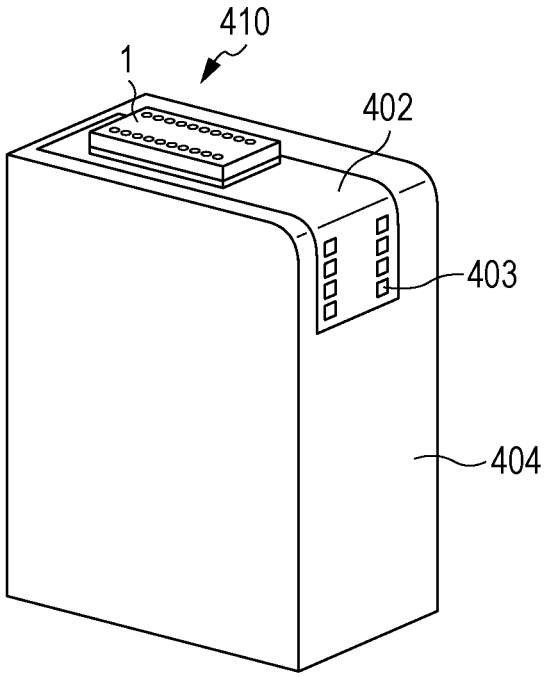
FIGS. 1A and 1B are perspective views of a liquid discharge head unit and a liquid discharge head.

FIG. 1A is a perspective view of a liquid discharge head unit 410. The liquid discharge head unit 410 is a unit of a cartridge form having a liquid discharge head integrated with a tank. The liquid discharge head unit 410 is attachable to and detachable from an interior of a carriage disposed on a body of a liquid discharge apparatus. The liquid discharge head unit 410 includes a liquid discharge head 1 attached thereto. The liquid discharge head unit 410 includes a tape member 402 for tape automated bonding (TAB) having a terminal to which electric power is supplied. Electric power is selectively supplied to individual heat resistors 108 (FIG. 2A) from the liquid discharge apparatus through the tape member 402. The electric power is supplied from contacts 403 through the tape member 402 to the liquid discharge head 1 so as to be supplied to the heat resistors 108. Furthermore, the liquid discharge head unit 410 includes a tank 404 which temporarily stores the liquid and which supplies the liquid to the liquid discharge head 1.

Liquid Discharge Head

Figure 1B:
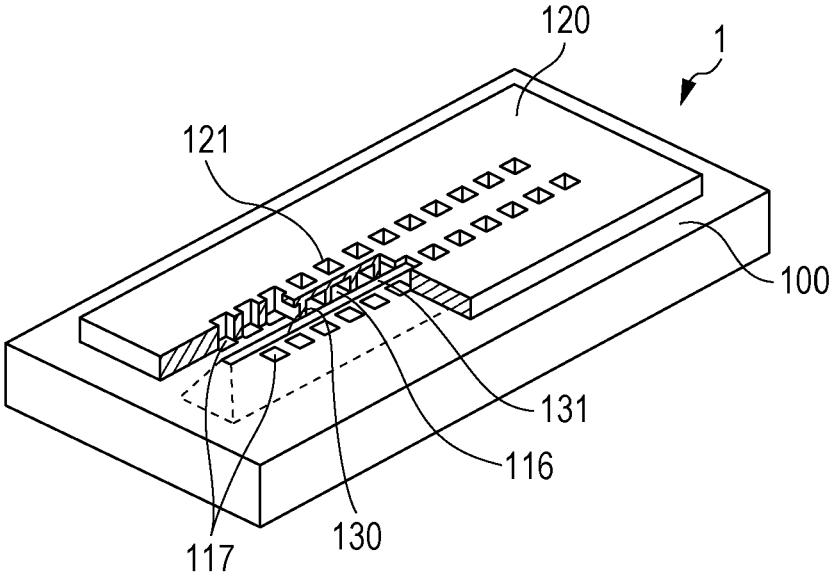

FIG. 1B is a perspective view obtained by breaking a portion of the liquid discharge head 1. The liquid discharge head 1 is formed such that a channel forming member 120 adheres to a liquid discharge head substrate 100. A plurality of liquid chambers 132 (FIG. 3A) which are capable of storing liquid inside thereof are formed between the channel forming member 120 and the liquid discharge head substrate 100. The liquid discharge head substrate 100 includes a liquid supply port 130 which penetrates from a front surface to a back surface of the liquid discharge head substrate 100. The channel forming member 120 includes a common liquid chamber 131 formed thereon which communicates with the liquid supply port 130. Furthermore, liquid channels 116 extending from the common liquid chamber 131 to the individual liquid chambers 132 are formed on the channel forming member 120. Accordingly, the channel forming member 120 is formed such that the common liquid chamber 131 communicates with the individual liquid chambers 132 through the liquid channels 116. Heat acting portions 117 are formed inside the liquid chambers 132. Discharge ports 121 are formed in positions corresponding to the heat acting portions 117 on the channel forming member 120. The plurality of heat acting portions 117 (heat resistors 108) are aligned, and the discharge ports 121 corresponding to the heat acting portions 117 are also aligned.

Here, a surface of the liquid discharge head substrate 100 on which liquid is discharged is referred to as a "front surface". Furthermore, a surface opposite to the surface of the liquid discharge head substrate 100 on which liquid is discharged is referred to as a "back surface".

The liquid is supplied from the tank 404 to the liquid discharge head 1 such that the liquid is supplied through the liquid supply port 130 included in the liquid discharge head substrate 100 to the common liquid chamber 131. The liquid supplied to the common liquid chamber 131 is further supplied into the individual liquid chambers 132 through the liquid channels 116. In this case, the liquid included in the common liquid chamber 131 is supplied to the liquid channels 116 and the liquid chambers 132 by capillary action and forms meniscus in the discharge ports 121 so that a surface of the liquid is stably maintained.

The heat resistors 108 are disposed on backsides of the heat acting portions 117. When liquid is to be discharged, the heat resistors 108 are energized through a line. When the heat resistors 108 are energized, thermal energy is generated in the heat resistors 108. By this, the liquid included in the liquid chambers 132 is heated, bubbles are generated due to film boiling, and droplets are discharged from the discharge ports 121 by bubble generation energy generated at this time.

Note that the liquid discharge head unit 410 is not limited to that integrated with a tank as described in the foregoing embodiment. For example, a liquid discharge head may be separated from a tank. In this case, when liquid in the tank runs out, only the tank is detached and a new tank is attached so that only the tank is replaced. Therefore, the liquid discharge head is not required to be replaced together with the tank, and operation cost may be suppressed low since frequency of the replacement of liquid discharge head is reduced.

Note that the liquid discharge apparatus may have a configuration in which a liquid discharge head and a tank are disposed in different positions and are connected to each other through a tube or the like so that liquid is supplied to the liquid discharge head. Furthermore, the liquid discharge head may employ a serial scan method in which scanning is performed in a main scanning direction. Furthermore, the liquid discharge apparatus may employ a liquid discharge head of a full-line type which extends over a range corresponding to an entire width of a recording medium. Furthermore, the liquid discharge head of the full-line type may be configured such that liquid discharge heads 1 are arranged in a staggered pattern or arranged on a straight line. Furthermore, a shape of the liquid discharge head 1 is not limited to a rectangle in a plan view and may be parallelogram, trapezoid, or the like.

Figure 2A:
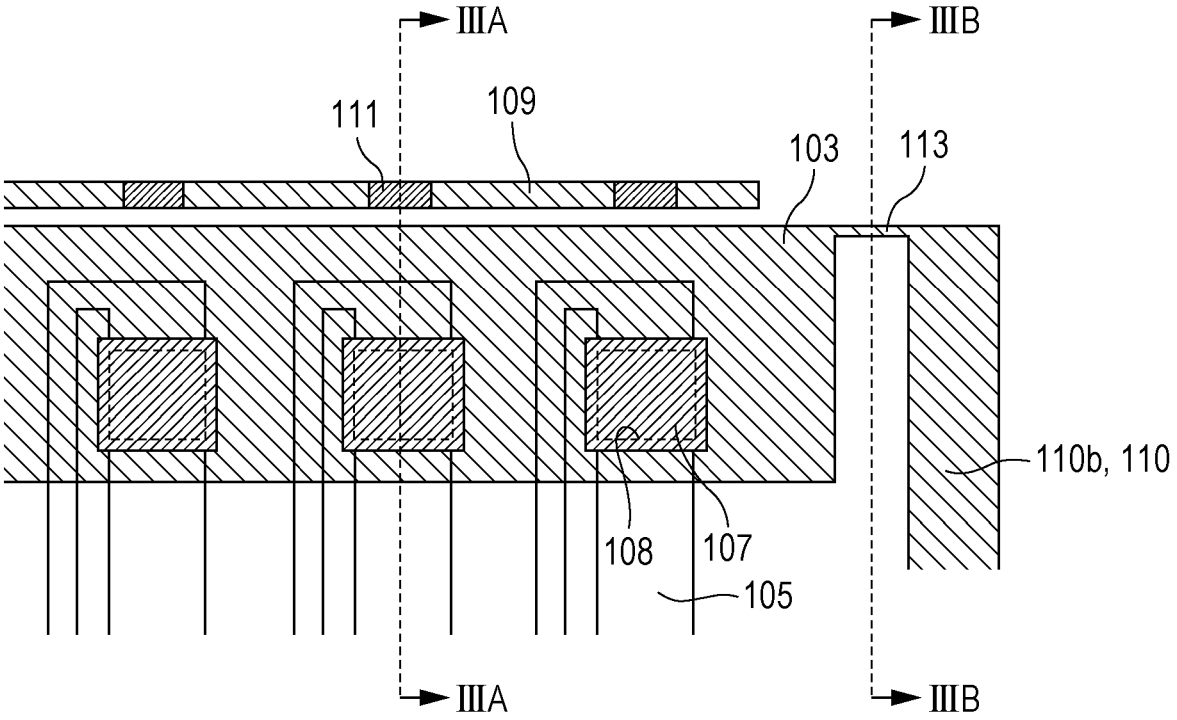
FIGS. 2A and 2B are plan views illustrating the liquid discharge head.
Figure 2B:
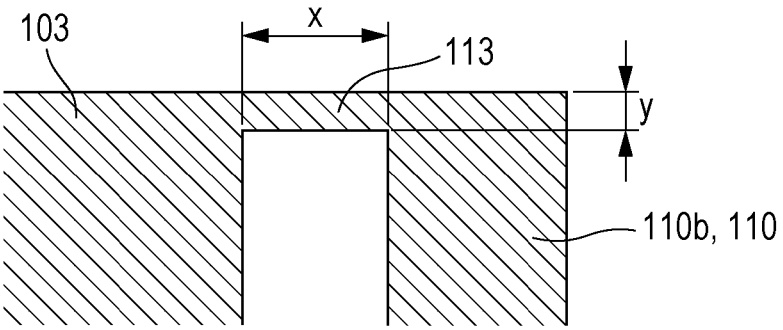
Figure 3A:
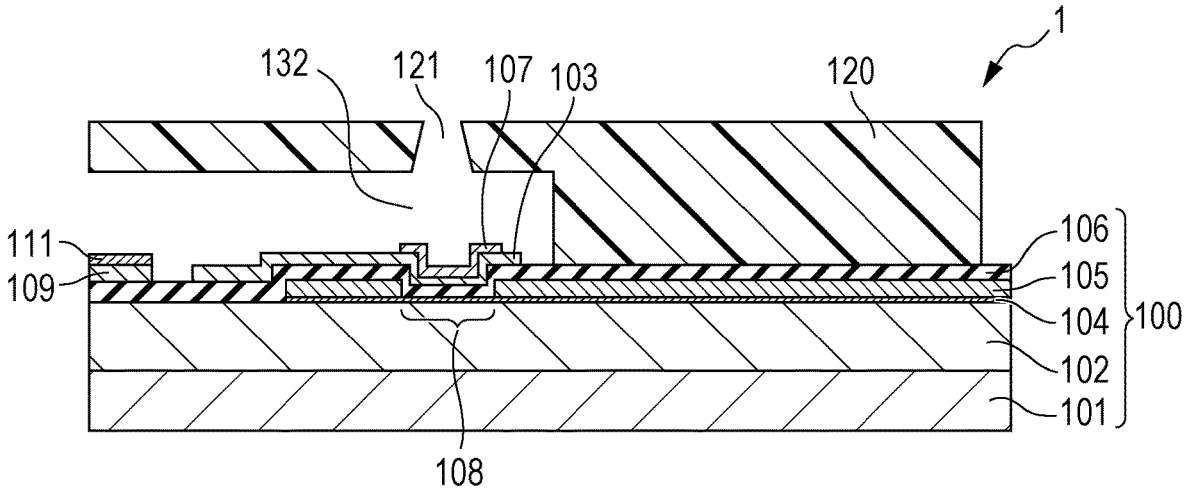
FIGS. 3A and 3B are cross-sectional views illustrating the liquid discharge head.
Figure 3B:
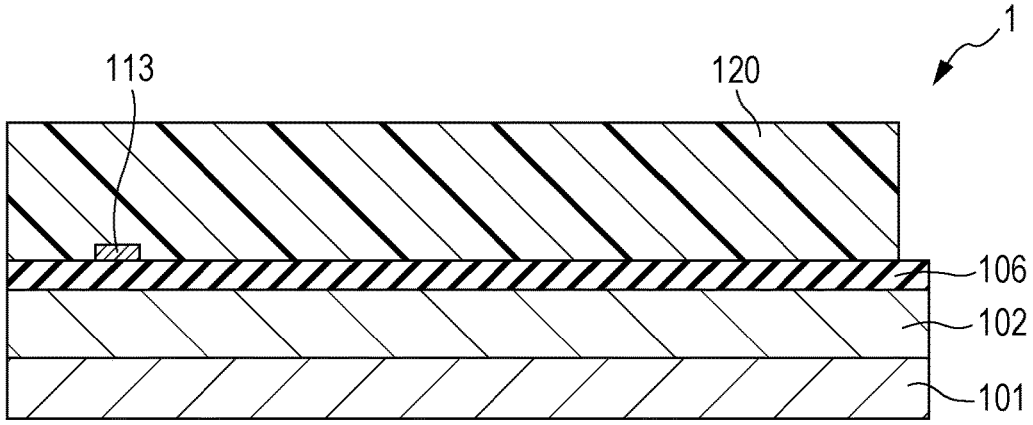

FIG. 2A is a plan view schematically illustrating the heat resistors 108 of the liquid discharge head 1 according to this embodiment viewed from above. FIG. 2B is an enlarged plan view of a fuse portion 113. The channel forming member 120 is omitted in FIGS. 2A and 2B. FIG. 3A is a cross-sectional view schematically illustrating the liquid discharge head 1 taken along a line IIIA to IIIA in FIG. 2A. FIG. 3B is a cross-sectional view schematically illustrating the liquid discharge head 1 taken along a line IIIB to IIIB in FIG. 2A.

Figure 4:
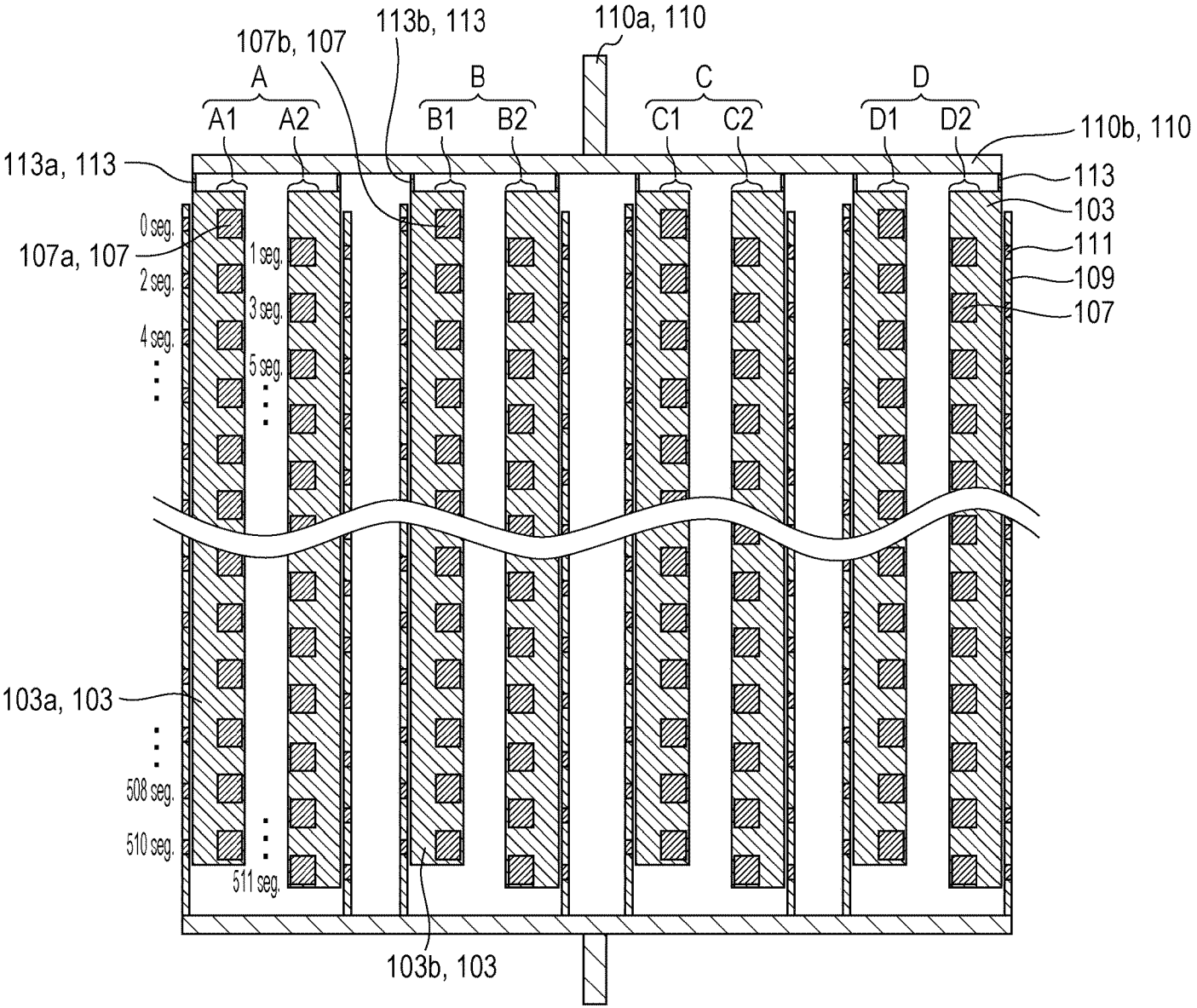
FIG. 4 is a plan view illustrating the liquid discharge head.
Figure 5:
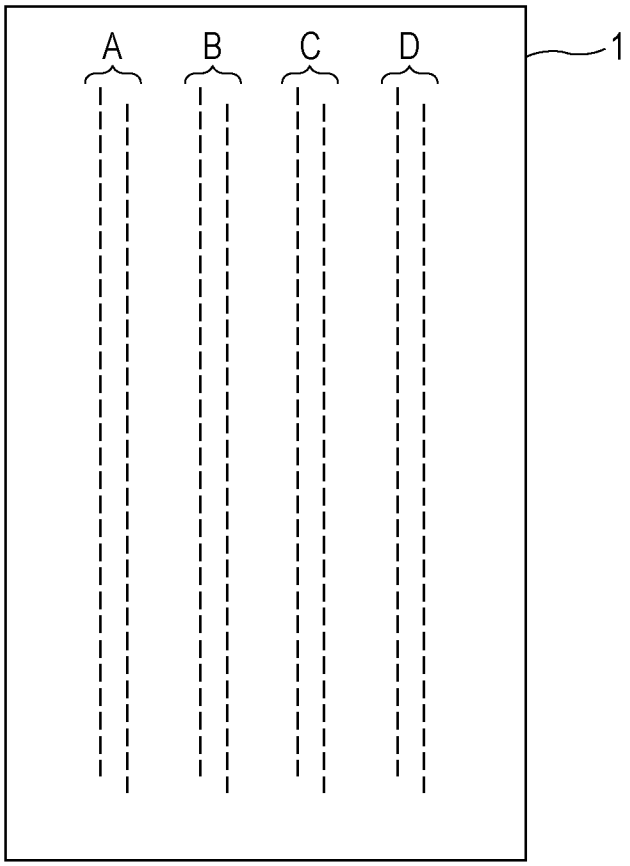
FIG. 5 is a plan view illustrating the liquid discharge head.

FIG. 4 is a plan view illustrating a configuration of the liquid discharge head 1 where the channel forming member 120 is omitted. FIG. 5 is a top view of the liquid discharge head 1. Heat resistor arrays A to D are disposed on the liquid discharge head 1, and heat resistors 108 of 512 segments (segs.) are arranged on each of the heat resistor arrays A to D. The heat resistors 108 included in the arrays A to D are arranged in a staggered pattern. Specifically, the heat resistor array A includes a heat resistor array A1 and a heat resistor array A2. Positions of the heat resistors 108 in the array A1 and positions of the heat resistors 108 in the array A2 are shifted in an array direction. Similarly, each of the heat resistor arrays B to D also includes two heat resistance arrays arranged in a straight line (arrays B1 and B2, arrays C1 and C2, and arrays D1 and D2).

Next, a lamination configuration of the liquid discharge head 1 will be described. As illustrated in FIG. 3A, the liquid discharge head 1 includes the liquid discharge head substrate 100 configured such that a plurality of layers are laminated on a base 101 formed of silicon. A heat accumulation layer 102 formed by a thermal oxide film, an SiO film, an SiN film, or the like is disposed on the base 101. Furthermore, a heat resistor layer 104 formed of TaSiN or the like is disposed on the heat accumulation layer 102. An electrode line layer 105 serving as a line formed of metallic material, such as Al, Al—Si, Al—Cu, or the like is disposed on the heat resistor layer 104. An insulating protection layer 106 is disposed on the electrode line layer 105. The insulating protection layer 106 is disposed on the layers such that the insulating protection layer 106 covers the heat resistor layer 104 and the electrode line layer 105. The insulating protection layer 106 is formed by an SiO film, an SiN film, an SiCN film, or the like.

Upper protective layers 107 are disposed on the insulating protection layer 106 so as to cover the heat resistors 108. The upper protective layers 107 protect the heat resistors 108 from chemical or physical impact caused by heat of the heat resistors 108. As illustrated in FIG. 2A, the upper protective layers 107 are disposed so as to cover the individual heat resistors 108. The upper protective layers 107 are formed of a platinum group, such as iridium (Ir) or ruthenium (Ru) or Tantalum (Ta). Note that the upper protective layers 107 may be formed of, instead of Ir, Ru, or Ta, an alloy including Ir, Ru, or Ta or formed by laminating Ir, Ru, and Ta. Note that the upper protective layers 107 formed by such material has conductivity.

The heat resistors 108 are formed by partially removing the electrode line layer 105. Specifically, the heat resistor layer 104 is exposed from portions of the electrode line layer 105 which is partially removed, and the portions of the heat resistor layer 104 which are exposed from the electrode line layer 105 function as the heat resistors 108. Furthermore, regions of the upper protective layers 107 which cover the heat resistors 108 function as the heat acting portions 117 which heat liquid. The electrode line layer 105 is connected to a driving element circuit, not illustrated, or an external power supply terminal and may not receive electric power which is externally supplied.

Note that the configuration of the heat resistors 108 is not limited to the configuration in which the electrode line layer 105 is disposed on the heat resistor layer 104 as described above. For example, a configuration in which the electrode line layer 105 is formed on the base 101 or the heat accumulation layer 102, portions of the electrode line layer 105 are removed so that gaps are formed, and the heat resistor layer 104 is disposed on the electrode line layer 105 may be employed. Furthermore, a configuration in which the electrode line layer 105 is embedded in the heat accumulation layer 102 and electric power is supplied through a metallic plug formed of tungsten or the like from the electrode line layer 105 to the heat resistor layer 104 formed as a single layer on the heat accumulation layer 102 may be employed.

As illustrated in FIG. 2A, the upper protective layers 107 which cover the respective heat resistors 108 included in the heat resistor array is electrically connected to a line 103. The line 103 is disposed so as to correspond to each of the heat resistor arrays and extends along the heat resistor arrays. As illustrated in FIG. 3A, the line 103 is disposed so as to cover the heat resistors 108. Furthermore, as illustrated in FIG. 4, the plurality of lines 103 (first and second common lines 103*a* and 103*b*) are electrically connected to a common line 110 (a third common line). The line 103 and the common line 110 are formed of Ta, Ru, or an alloy including Ru or Ta, for example.

Furthermore, the fuse portions 113 are disposed between the plurality of lines 103 and the common line 110. Furthermore, the fuse portions 113 are disposed in end portions of the heat resistor arrays. The first and second common lines 103*a* and 103*b* are connected to the common line 110 through first and second fuse portions 113*a* (113) and 113*b* (113), respectively. Note that the fuse portions 113 may be formed of the same material as the common line 110.

In this embodiment, the upper protective layers 107 formed of Ir have a thickness in a range from 20 to 100 nm, and the fuse portions 113, the lines 103, and the common line 110 formed of Ta have a thickness in a range from 30 to 250 nm. A width of the fuse portions 113 (y in FIG. 2B) is in a range from 2 to 5 μm, and a length of the fuse portions 113 (x in FIG. 2B) is in a range from 5 to 10 μm.

Furthermore, in the liquid discharge apparatus according to this embodiment, the cleaning process is periodically performed to remove kogation deposited on the upper protective layers 107. In this cleaning process, a voltage is applied between the upper protective layers 107 and electrodes 111 (FIG. 3A) disposed in the liquid chambers including the respective upper protective layers 107 and surfaces of the upper protective layers 107 on which the kogation is attached are dissolved by electrochemical reaction with liquid. The electrodes 111 are formed of Ir, and lines 109 connected to the electrodes 111 are formed of Ta. The cleaning process is performed such that a positive potential of 0V (equal to GND) is applied to the electrodes 111 and a positive potential in a range from +5 to +10 V is applied to the upper protective layers 107.

Figure 8A:
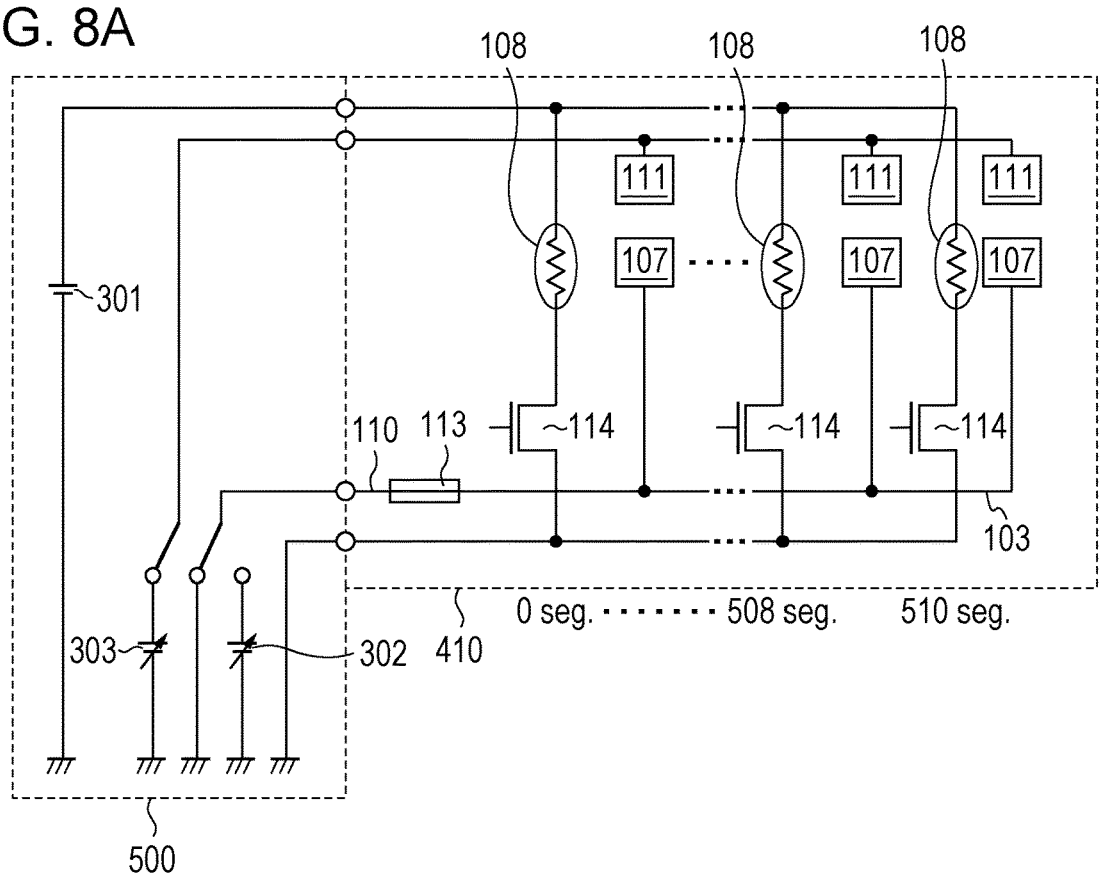
FIGS. 8A and 8B are diagrams illustrating circuits of the liquid discharge head unit and a body of a liquid discharge apparatus.
Figure 8B:
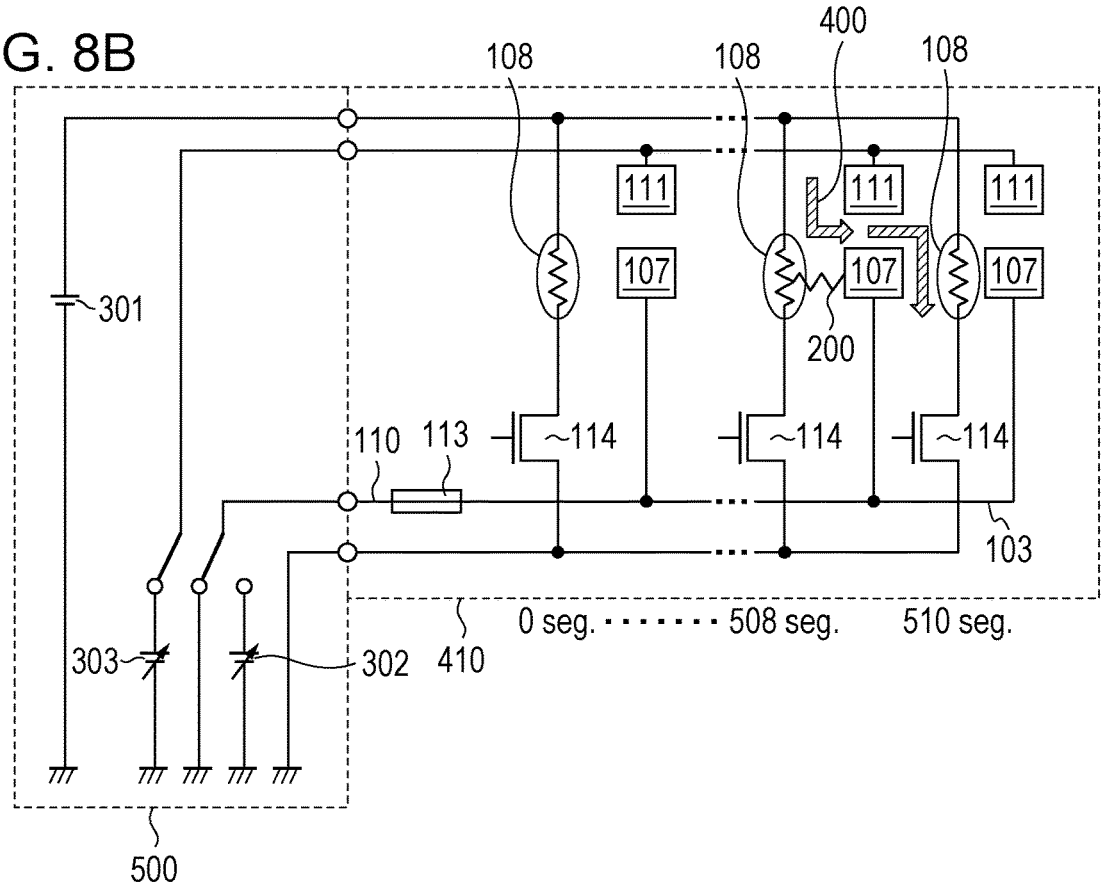

FIGS. 8A and 8B are circuit diagrams illustrating the liquid discharge head unit 410 including the liquid discharge head 1 and a liquid discharge apparatus body 500 including the liquid discharge head unit 410 disposed thereon. FIG. 8A is a circuit diagram in a normal state and FIG. 8B is a circuit diagram in which conduction between the heat resistors 108 and the upper protective layer 107 occurs.

The individual heat resistors 108 are selected by a power source 301, respective switching transistors 114, and a selection circuit and are driven. The power source 301 disposed on the liquid discharge apparatus body 500 supplies a driving voltage of 16 to 32 V, for example, and the power source 301 supplies a voltage of 24 V in this embodiment. With this configuration, the heat resistors 108 may generate heat by supplying electric power from the power source 301 to the heat resistors 108 at a predetermined timing so that liquid is bubbled at a predetermined timing and droplets are discharged.

Since the insulating protection layer 106 is disposed between the heat resistors 108 and the upper protective layers 107 as described above, the heat resistors 108 and the upper protective layers 107 are not electrically connected to each other. The upper protective layers 107 which cover the respective heat resistors 108 included in the heat resistor arrays are electrically connected to one another through the lines 103, and the lines 103 are connected to the common line 110 through the fuse portions 113. Furthermore, the common line 110 may be connected to an external power source 302. Note that, although the circuit diagrams of a single heat resistor array are illustrated in FIGS. 8A and 8B, the common line 110 is connected to the lines 103 corresponding to the heat resistor arrays as described above.

During a process of recording, conduction may occur between one of the heat resistors 108 and a corresponding one of the upper protective layers 107 due to an accidental failure of the heat resistor 108 for some reason, and accordingly, current is supplied. It is likely that, for example, when one of the heat resistors 108 is damaged due to an accidental failure, the heat resistor 108 and a portion of a corresponding one of the upper protective layers 107 melt and are directly in contact with each other so that conduction 200 occurs. FIG. 8B is an image diagram illustrating a state in which conduction 200 occurs between the heat resistor 108 and the upper protective layer 107 and a portion of current supplied to the electrode line layer 105 is supplied to the upper protective layer 107. When the conduction 200 occurs between the heat resistor 108 and the upper protective layer 107, current 400 is supplied to the upper protective layer 107 when the heat resistor 108 is driven.

When the conduction occurs as described above, a potential applied to the heat resistor 108 is also applied to the upper protective layer 107. If the upper protective layers 107 are formed of Ta, entire upper protective layers 107 near the upper protective layer 107 are affected by electrochemical reaction, and accordingly, anodization is started. When anodization progresses, oxidized Ta is dissolved in the liquid, and therefore, the life of the upper protective layers 107 is reduced and durability is degraded. Furthermore, when the upper protective layers 107 are formed of Ir, entire upper protective layers 107 near the upper protective layer 107 are dissolved in the liquid due to the electrochemical reaction between the upper protective layers 107 and the liquid, and therefore, the durability of the upper protective layers 107 are degraded.

Figure 6:
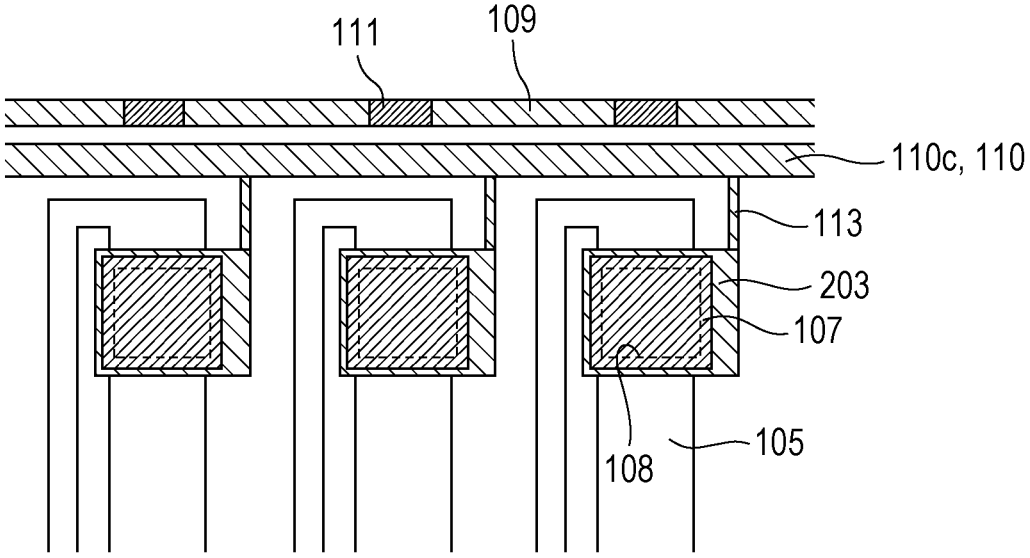
FIG. 6 is a plan view illustrating a liquid discharge head of a comparative example.
Figure 7:
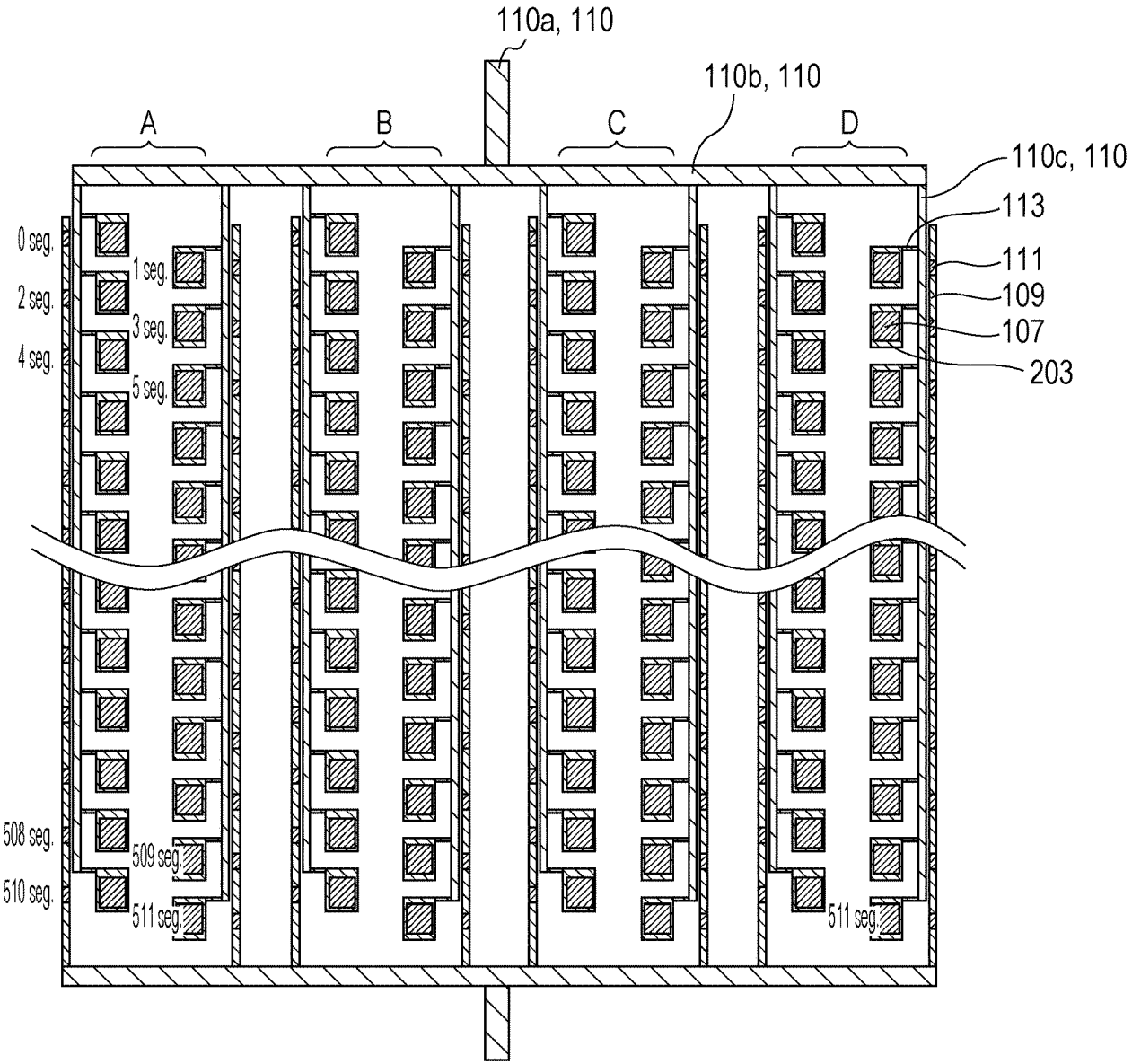
FIG. 7 is a plan view illustrating the liquid discharge head of the comparative example.

Here, a liquid discharge head in a comparative example will be described. FIG. 6 is a plan view schematically illustrating heat resistors 108 of the liquid discharge head of the comparative example viewed from above. FIG. 7 is a top view illustrating an entire configuration of the liquid discharge head of the comparative example partially illustrated in FIG. 6. Components that are the same as those of the foregoing embodiment are denoted by the same reference numerals in FIGS. 6 and 7. A channel forming member 120 is omitted in FIGS. 6 and 7. Heat resistor arrays A to D are disposed on the liquid discharge head of the comparative example, and 512 segments (segs.) of heat resistors 108 are arranged on each of the heat resistor arrays A to D.

To avoid propagation of degradation of durability of one of upper protective layers 107 due to conduction between one of the heat resistors 108 and the upper protective layer 107 described above, the liquid discharge head of the comparative example is configured such that fuse portions 113 are connected to the respective upper protective layers 107 which cover the heat resistors 108.

Each of the upper protective layers 107 is connected to a common line 110*c* through a corresponding one of discrete lines 203 which covers a corresponding one of the heat resistors 108 and a corresponding one of the fuse portions 113 connected to the discrete line 203. Therefore, when the conduction occurs between one of the heat resistors 108 and a corresponding one of the upper protective layers 107, current is supplied to a corresponding one of the fuse portions 113 so that the fuse portion 113 is disconnected. Since a potential is not applied to the other upper protective layers 107 which cover the heat resistors 108 other than the heat resistor 108 corresponding to the conduction with the upper protective layer 107 and the discrete lines 203, spread of influence of degradation of the durability of the upper protective layer 107 caused by the conduction may be suppressed in a large area.

However, in recent years, sizes of liquid discharge heads are increased, the number of heat resistors 108 per array is increased, and a length of heat resistor arrays is increased. As illustrated in the comparative example of FIG. 7, the common line 110*c* becomes long as the length of the heat resistor arrays is increased, and a width of the common line 110*c* is reduced since the common line 110 is formed between the heat resistor arrays. Accordingly, line resistance of the common line 110 is increased. For example, in the head illustrated in FIG. 7, fuse portions 113 corresponding to a heat resistor 108 of 510-th seg. in the A array and a heat resistor 108 of 511-th seg. in the D array have line resistance from a common line 110*a*. Therefore, when an accidental failure occurs in one of these heat resistors 108, smaller current is supplied to the corresponding one of the fuse portions 113, and therefore, the fuse portion 113 may not be securely disconnected.

If the fuse portion 113 is not disconnected, the current may be supplied through a common line 110*b* or the common line 110*c* to the other upper protective layers 107 which are other than the upper protective layer 107 in which the conduction with the heat resistors 108 occurs. Specifically, influence of degradation of durability of the upper protective layer 107 caused by the conduction between the heat resistor 108 and the upper protective layer 107 may not be suppressed, and the influence may spread over a wide range in the liquid discharge head.

Therefore, in this embodiment, the fuse portions 113 are provided for the respective heat resistor arrays as illustrated in FIG. 4. Specifically, each of the fuse portions 113 is commonly provided for the upper protective layers 107 which cover the plurality of heat resistors 108 included in a corresponding one of the heat resistor arrays. Furthermore, each of the fuse portions 113 connects the common line 110*b* with an end portion of the line 103 along a heat resistor array direction. Therefore, in this embodiment, a largest value of line resistance in a range from the common line 110*a* which is an end portion opposite to the fuse portions 113 of the common line 110 to the fuse portions 113 is smaller than that of a configuration in which the fuse portions 113 are provided for the respective upper protective layers 107 as illustrated in the comparative example of FIG. 7. Therefore, even in a case of a head having long heat resistor arrays, the fuse portion 113 is easily disconnected.

When the conduction occurs between one of the heat resistors 108 and a corresponding one of the upper protective layers 107 and current is supplied to the upper protective layer 107, electric power is also supplied to a corresponding one of the fuse portions 113. Since each of the fuse portions 113 is thinner than the upper protective layers 107, the lines 103, and the common line 110*b*, current density in the fuse portion 113 is increased, and therefore, the fuse portion 113 is disconnected (electrically insulated).

According to this embodiment, influence of degradation of durability to the upper protective layers 107 which cover the heat resistor arrays which are different from the heat resistor array including the heat resistor 108 in which the conduction with the upper protective layer 107 occurs may be suppressed. Specifically, spread of the degradation of the durability over the head due to change of quality of the upper protective layer 107 may be suppressed.

Furthermore, in this embodiment, the plurality of heat resistor arrays which discharge liquid of the same color are arranged in positions in which the arrays may be complementary to each other. Therefore, even when one of the fuse portions 113 is disconnected due to the conduction, one of the heat resistor arrays which corresponds to the disconnected fuse portion 113 may be complemented with another heat resistor array. By this, frequency of replacement of the liquid discharge head may be suppressed, long life of the liquid discharge head may be realized, and running cost of the liquid discharge apparatus may be suppressed low.

Specifically, in FIG. 4, the heat resistor array A1 serving as a first heat resistor array and the heat resistor array B1 serving as a second heat resistor array are positioned complementary to each other. Furthermore, first conductive covering portions 107*a* (107) cover the respective heat resistors 108 included in the first heat resistor array. Second conductive covering portions 107*b* (107) cover the respective heat resistors 108 included in the second heat resistor array. Furthermore, the first common line 103*a* (103) is electrically connected to the first covering portions 107*a* and extends in a direction of the first heat resistor array. The second common line 103*b* (103) is electrically connected to the second covering portions 107*b* and extends in a direction the second heat resistor array. Moreover, the common line 110*b* (110) electrically connected to the first and second common lines 103*a* and 103*b* is disposed. The first fuse portion 113*a* (113) which connects an end portion of the first common line 103*a* in the direction of the first heat resistor array to the third common line 110*b* is also provided. A second fuse portion 113*b* (113) which connects an end portion of the second common line 103*b* in the direction of the second heat resistor array to the third common line 110*b* is also provided.

Furthermore, the fuse portions 113 are provided for the respective heat resistor arrays, and therefore, the lines 103 may be commonly connected to the plurality upper protective layers 107 instead of the discrete lines 203 for the respective upper protective layers 107 as illustrated in the comparative example. In this embodiment, the lines 103 extend in a direction of the heat resistor arrays and are formed as bands. By this, line resistance of the lines 103 in this embodiment is lower than that of the common line 110*c* extending in the direction of the heat resistor arrays on the head of the comparative example illustrated in FIG. 7. In this embodiment, the line resistance of the lines 103 may be approximately 1/7 of the line resistance of the common line 110*c* of the head of the comparative example. Accordingly, the fuse portions 113 may be more easily disconnected. Furthermore, at least a portion of the upper protective layers 107 and at least a portion of the lines 103 overlap with each other when viewed from an orthogonal direction relative to a surface of the liquid discharge head substrate 100, and therefore, low line resistance is obtained while increase in an area of the substrate is suppressed.

Note that the configuration in which the fuse portions 113 are connected to end portions of the common lines 103 has been described. However, the fuse portions 113 are at least connected to portions in the vicinity of end regions of the lines 103 including ends of the lines 103.

Process of Fabricating Liquid Discharge Head

A process of fabricating a liquid discharge head will be described. FIGS. 9A to 9E are cross-sectional views schematically illustrating the process of fabricating a liquid discharge head according to this embodiment.

Note that, according to a normal process of fabricating a liquid discharge head, the liquid discharge head 1 is fabricated by laminating the individual layers on the base 101 formed of Si in a state in which a driving circuit is formed in the base 101 in advance. Semiconductor elements or the like, such as the switching transistors 114, which selectively drive the heat resistors 108 are disposed on the base 101 in advance as driving circuits and the various layers are laminated on the base 101 so that the liquid discharge head 1 is fabricated. However, the driving circuits and the like disposed in advance are not illustrated for simplicity, and only the base 101 is illustrated in FIGS. 9A to 9E.

First, the heat accumulation layer 102 formed by a thermal oxide film of $SiO_2$ is formed as a lower layer of the heat resistor layer 104 on the base 101 by a thermal oxidation method, a spattering method, a chemical vapor deposition (CVD) method, or the like. Note that, as for a base including driving circuits disposed thereon in advance, a heat accumulation layer may be formed in a process of fabricating the driving circuits.

Figure 9A:
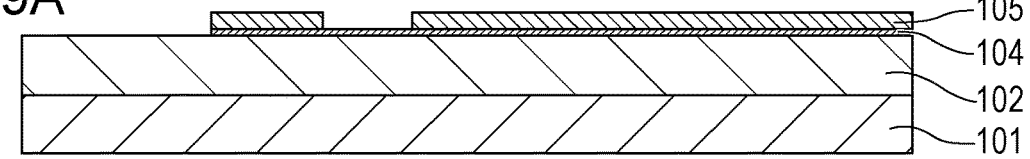
FIGS. 9A to 9E are cross-sectional views illustrating a process of fabricating the liquid discharge head.

Next, the heat resistor layer 104 formed of TaSiN is formed on the heat accumulation layer 102 by reaction spattering in a thickness of approximately 20 nm. Furthermore, the electrode line layer 105 is formed by forming an A1 layer in a thickness of approximately 300 nm on the heat resistor layer 104 by spattering. Then dry etching is simultaneously performed on the heat resistor layer 104 and the electrode line layer 105 by a photolithography method. By this, the heat resistor layer 104 and the electrode line layer 105 are partially removed so that the heat resistor layer 104 and the electrode line layer 105 having shapes illustrated in FIG. 9A are formed. Note that, in this embodiment, a reactive ion etching (RIE) method is used as the dry etching.

Figure 9B:
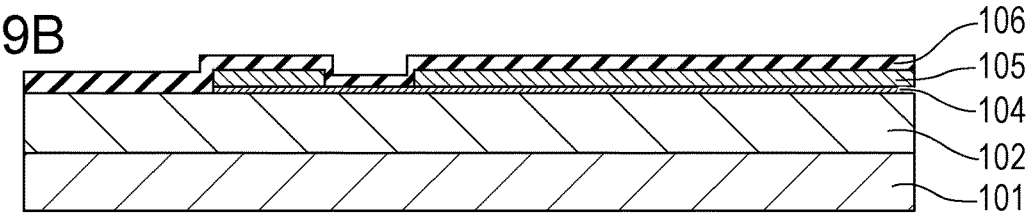

Next, as illustrated in FIG. 9B, an SiN film having a thickness of approximately 200 nm is formed by a plasma CVD method to form the insulating protection layer 106 as illustrated in FIG. 9B.

Figure 9C:
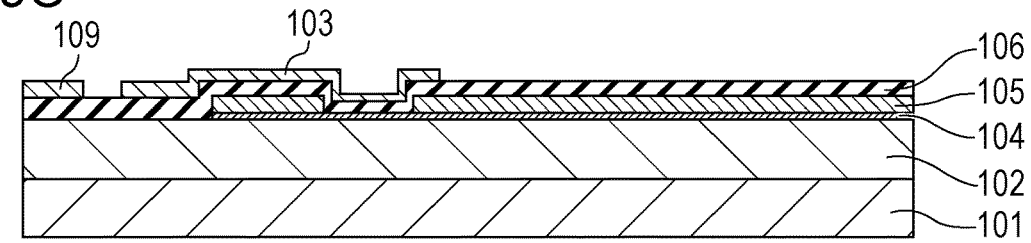

Subsequently, a Ta layer having a thickness of approximately 100 nm is formed by spattering on the insulating protection layer 106. The Ta layer is partially removed by dry etching using the photolithography method so that the lines 103, the common line 110, the fuse portions 113, and the line 109 are formed (FIG. 9C). Note that, in FIG. 9C, the common line 110 and the fuse portions 113 are not illustrated. The fuse portions 113 are designed such that a width of the fuse portions 113 is 2 μm which is nearly the minimum limitation size of the photolithography method, and when current is supplied to the fuse portions 113, current density of the fuse portions 113 becomes large and the fuse portions 113 are easily disconnected.

Figure 9D:
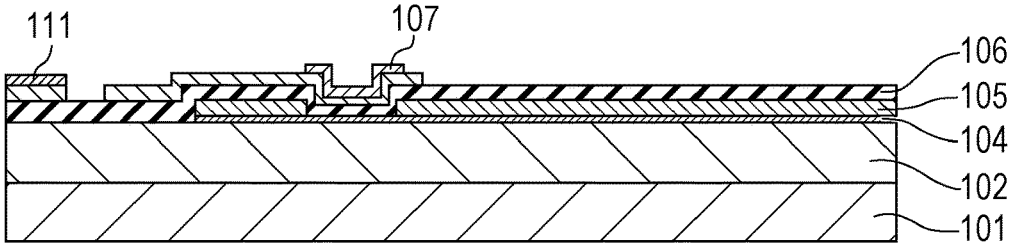

Subsequently, an Ir layer having a thickness of 30 nm is formed. The Ir layer is partially removed by the dry etching using the photolithography method so that the upper protective layers 107 are formed on regions on the heat resistors 108, and in addition, the counter electrode 111 is formed (FIG. 9D).

Figure 9E:
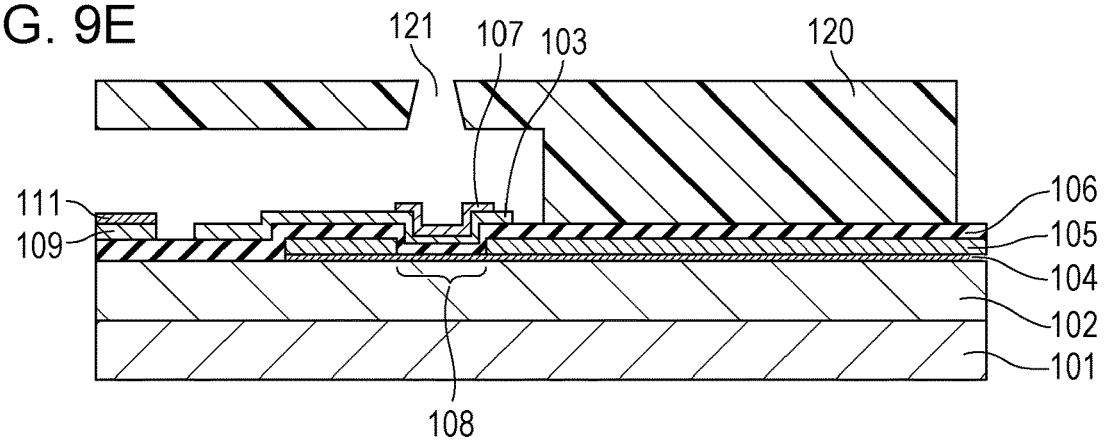

Next, FIG. 9E is a cross sectional view schematically illustrating a process of fabricating liquid chambers and liquid channels using the substrate described above. A resist is applied by a spin coat method as a solid layer which may be dissolved and which finally serves as the liquid chambers on the liquid discharge head substrate 100 configured such that the layers described above are formed on the base 101. A resist member is formed of polymethyl isopropenyl ketone and acts as a negative resist. Thereafter, the resist layer is patterned in a desired shape of the liquid chambers by means of the photolithography technique. Subsequently, a coating resin layer is formed to form liquid channel walls and the discharge ports 121 included in the channel forming member 120. Before the coating resin layer is formed, a silane coupling treatment or the like may be performed where appropriate so as to improve adhesion. The coating resin layer may be formed by appropriately selecting a coating method which is generally used and by applying resin on the liquid discharge head substrate 100 including a liquid chamber pattern formed thereon. Subsequently, the coating resin layer is patterned in liquid channel walls and discharge ports of desired shapes. Thereafter, a liquid supply port (not illustrated) is formed by an anisotropic etching method, a sandblast method, an anisotropic plasma etching method, or the like from the back surface of the liquid discharge head substrate 100. Most preferably, the liquid supply port may be formed by a chemical silicone anisotropic etching method employing tetramethyl hydroxylamine (TMAH), NaOH, or KOH. Subsequently, an entire surface is exposed using Deep-UV light and developing and drying are performed so that the dissolvable solid layer is removed.

The liquid discharge head is fabricated through the process described above.

Second Embodiment

A liquid discharge head having a configuration the same as that of the foregoing embodiment is used in this embodiment, and therefore, descriptions of configurations the same as those of the foregoing embodiment are omitted.

In the foregoing embodiment, in the heat resistor array A1, for example, electric resistance between the upper protective layers 107 which cover the heat resistors 108 of a 508-th seg. and a 510-th seg. and the fuse portions 113 is comparatively high. Therefore, in a case where a heat resistor array is long, if conduction occurs between a heat resistor 108 and an upper protective layer 107, a fuse portion 113 may not be disconnected. Therefore, in this embodiment, control is performed so that fuse portions 113 are securely disconnected irrespective of portions where the conduction occurs.

Figure 10A:
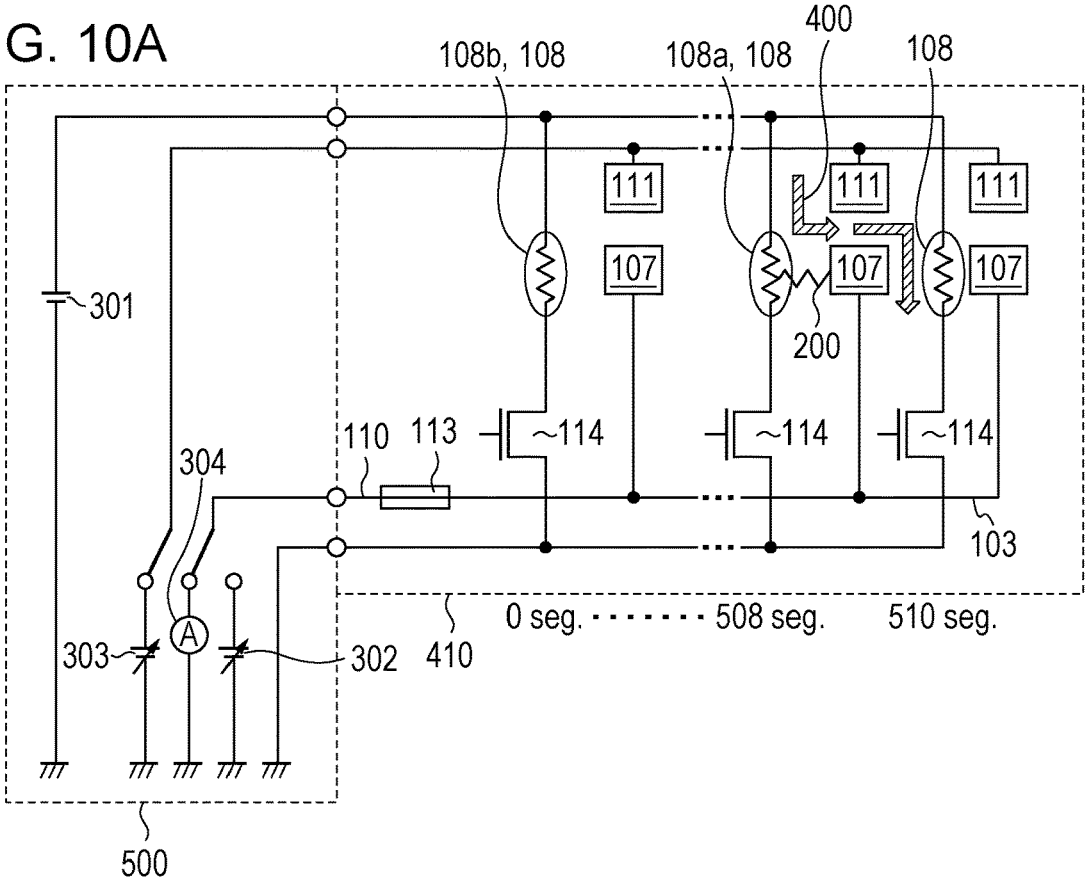
FIGS. 10A and 10B are diagrams illustrating circuits of the liquid discharge head unit and the body of the liquid discharge apparatus.
Figure 10B:
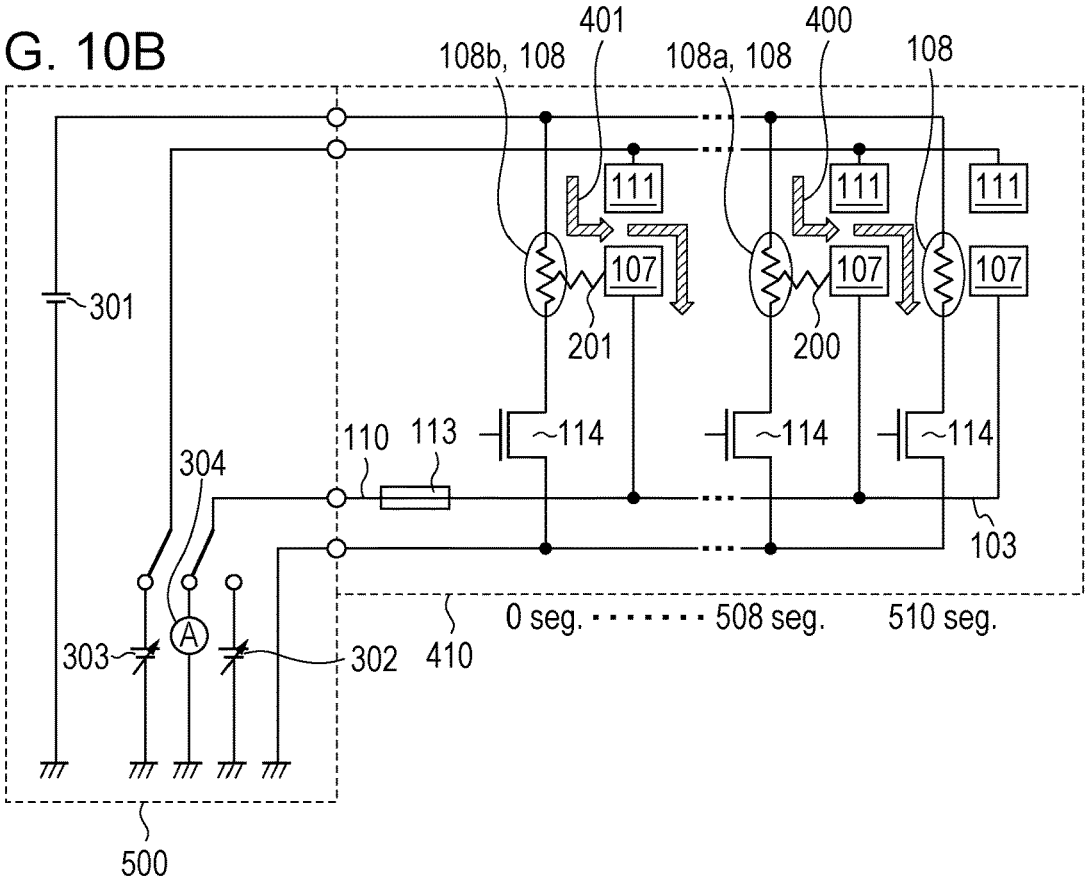
Figure 11:
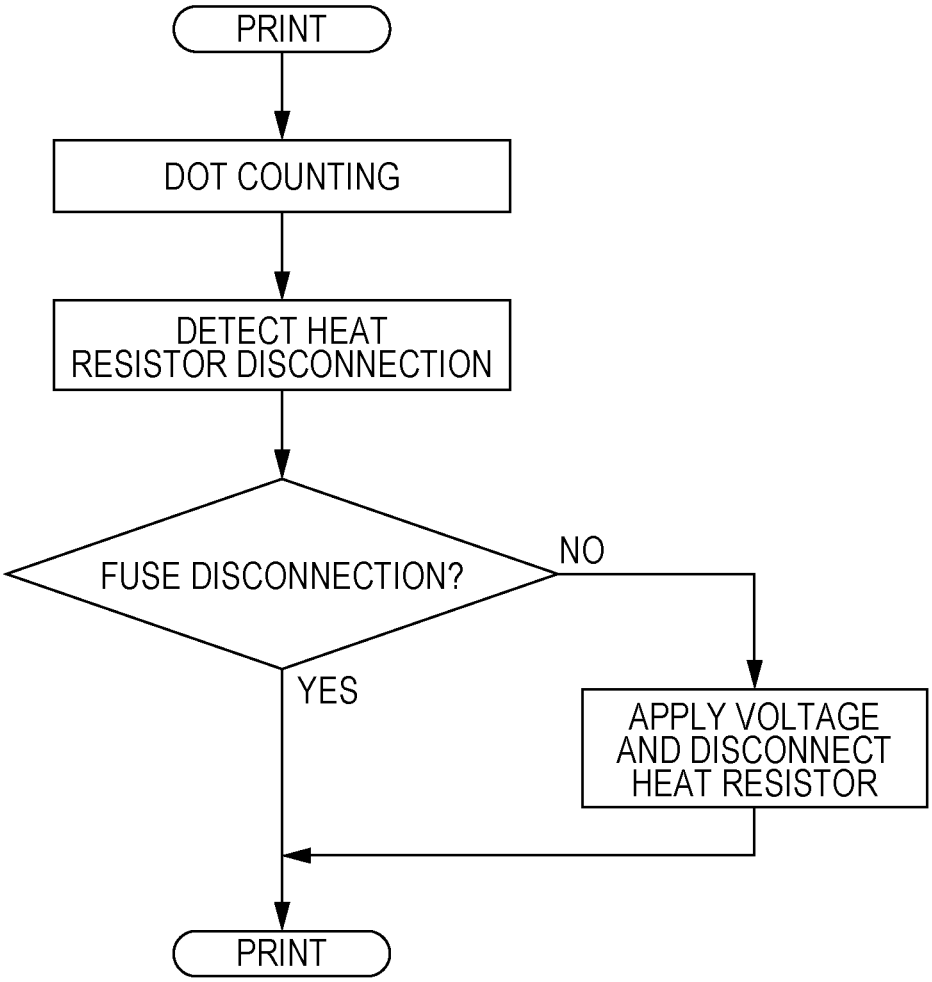
FIG. 11 is a flowchart of a process of disconnecting a fuse portion of the liquid discharge head.

FIGS. 10A and 10B are circuit diagrams illustrating a liquid discharge head unit 410 including a liquid discharge head 1 and a liquid discharge apparatus body 500 including the liquid discharge head unit 410 disposed thereon. FIG. 11 is a flowchart of a process of disconnecting a fuse portion 113 in this embodiment.

A liquid discharge apparatus according to this embodiment employs dot counting and may periodically perform disconnection detection of a heat resistor using a disconnection detection unit during printing. As an example of the disconnection detection unit, current of approximately 10 mA which does not trigger discharge (an amount in which liquid is not discharged) is supplied to the heat resistors 108 in individual segments and a determination as to whether current has been supplied is made using an ammeter so as to determine whether disconnection has occurred. Note that the disconnection detection unit and a method for detection are not particularly limited as long as the disconnection detection unit may determine whether the individual heat resistors 108 normally discharge droplets.

Furthermore, an ammeter 304 is connected to the common line 110 so as to detect disconnection of the fuse portions 113.

Next, a method for disconnecting a fuse portion 113 according to this embodiment will be described in detail with reference to FIGS. 10A, 10B, and 11. FIGS. 10A and 10B are circuit diagrams including a heat resistor array A1 serving as a first heat resistor array. In FIG. 10A, a heat resistor 108 (a first heat resistor 108*a*) in the 508-th seg. is disconnected due to an accidental failure caused by printing, and conduction 200 is generated between the heat resistor 108 in the 508-th segment and a corresponding one of the heat resistors 108 which covers the heat resistor 108.

First, when it is determined that discharge is performed a predetermined number of times by dot counting, the disconnect detection unit determines whether the heat resistors 108 has been disconnected.

Thereafter, when the disconnection of the heat resistor 108 (the heat resistor 108*a* of the 508-th segment in FIG. 10A) is detected, the ammeter 304 determines whether current has been supplied to a fuse portion 113. When the current has not been supplied, it is determined that the fuse portion 113 is disconnected (YES). In the case of the disconnection, the printing is continuously performed.

On the other hand, when the current has been supplied, it is determined that the fuse portion 113 has not been disconnected (NO). When the fuse portion 113 is not disconnected, a voltage is applied to one of the heat resistors 108 in the heat resistor array including the disconnected heat resistor 108 which is most close to the fuse portion 113 (a heat resistor 108*b* (a second heat resistor) in a 0-th segment in FIG. 10B). In this way, the heat resistor 108 is disconnected and conduction 201 is generated between the heat resistor 108 and one of the upper protective layers 107 which covers the heat resistor 108 (FIG. 10B). In this case, energy larger than energy required for normal print driving is applied to the heat resistor 108 so that the conduction 201 occurs by design. In a case where a normal print driving condition is 24.0 V and a pulse width is 4.0 μs, for example, when the conduction 201 is to be generated, energy corresponding to a voltage of 29.0 V and a pulse width of 1.3 μs is applied to the heat resistor 108 in a 0-th seg. When the conduction 201 occurs between the heat resistor 108 in the 0-th seg. and a corresponding one of the upper protective layers 107 which covers the heat resistor 108, a driving voltage (a driving power source 301 of FIG. 10B) to be applied to the heat resistors 108 is applied to the upper protective layers 107. Therefore, current 401 is supplied to the fuse portion 113, and therefore, the fuse portion 113 is disconnected. Note that energy of half as large again as energy applied to the heat resistor 108 at a time of normal printing is preferably applied to the heat resistor 108 in the 0-th segment so that the fuse portion 113 is reliably disconnected.

In the upper protective layers 107 which cover the heat resistor array, one of the upper protective layers 107 which covers the heat resistor 108 in the 0-th segment positioned in an end portion of the heat resistor array on the fuse portions 113 side has smallest line resistance between the upper protective layer 107 and the fuse portion 113. Therefore, the current 401 supplied to the fuse portion 113 is less affected by line resistance of the line 103, and a potential which is less dropped from a voltage applied to the upper protective layer 107 is applied to the fuse portion 113. Accordingly, current larger than that supplied when the heat resistor 108 of one of the other segments is disconnected is supplied to the fuse portion 113, and therefore, the fuse portion 113 may be more securely disconnected.

Note that, although the case where one of the heat resistors 108 which corresponds to one of the upper protective layers 107 which has a smallest line resistance with a corresponding one of the fuse portions 113 in the heat resistor arrays is disconnected is described as the example in the foregoing embodiment, this embodiment is not limited to this. Specifically, one of the heat resistors 108 (a second heat resistor) which is covered by a corresponding one of the upper protective layers 107 having at least a smaller line resistance with a corresponding one of the fuse portions 113 when compared with one of the upper protective layers 107 which covers one of the heat resistors 108 (a first heat resistor) which is disconnected due to an accidental failure is disconnected on purpose. However, in terms of disconnection of the fuse portions 113, as described above, one of the heat resistors 108 corresponding to one of the upper protective layers 107 having a smallest line resistance with a corresponding one of the fuse portions 113 is preferably disconnected in the heat resistor arrays.

Furthermore, as for positions of the fuse portions 113, although the case where the fuse portions 113 are disposed in end portions of the line 103 is described as an example, the positions of the fuse portions 113 are not limited to these. Specifically, one fuse portion 113 is provided for one heat resistor array. When the fuse portion 113 is not disconnected, one of the heat resistors 108 which is covered by one of the upper protective layers 107 having a smaller line resistance with a corresponding one of the fuse portions 113 when compared with one of the upper protective layers 107 which covers one of the heat resistors 108 in which an accidental failure occurs is disconnected on purpose.

As described above, according to the foregoing embodiments, influence of transform of quality to an entire liquid discharge head is suppressed when a heat resistor and a covering portion are electrically connected to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-195985 filed Oct. 6, 2017, which is hereby incorporated by reference herein in its entirety.

What is claimed is:

1. A liquid discharge head substrate comprising:

a first heat resistor array including a plurality of heat resistors;

a second heat resistor array including a plurality of heat resistors which are arranged along the first heat resistor array;

a plurality of first covering portions which have conductivity and which cover the respective heat resistors included in the first heat resistor array;

a plurality of second covering portions which have conductivity and which cover the respective heat resistors included in the second heat resistor array;

a first common line which is electrically connected to the plurality of first covering portions and which extends in a direction of the first heat resistor array;

a second common line which is electrically connected to the plurality of second covering portions and which extends in a direction of the second heat resistor array;

a third common line which is electrically connected to the first and second common lines;

the first covering portions being insulated from the heat resistors covered by the first covering portions, and the second covering portions being insulated from the heat resistors covered by the second covering portions, a first fuse portion which connects an end portion of the first common line in the direction of the first heat resistor array to the third common line; and a second fuse portion which connects an end portion of the second common line in the direction of the second heat resistor array to the third common line.

2. The liquid discharge head substrate according to claim 1, wherein at least portions of the first covering portions overlap with the first common line and at least portions of the second covering portions overlap with the second common line when viewed from a direction orthogonal to a surface of the liquid discharge head substrate having the first and second heat resistor arrays.

3. The liquid discharge head substrate according to claim 1, wherein the first and second heat resistor arrays discharge liquid of the same color and are disposed in positions complementary to each other.

4. A liquid discharge head, comprising:

a liquid discharge head substrate including:

a first heat resistor array including a plurality of heat resistors;

a second heat resistor array including a plurality of heat resistors which are arranged along the first heat resistor array;

a plurality of first covering portions which have conductivity and which cover the respective heat resistors included in the first heat resistor array;

a plurality of second covering portions which have conductivity and which cover the respective heat resistors included in the second heat resistor array;

a first common line which is electrically connected to the plurality of first covering portions and which extends in a direction of the first heat resistor array;

a second common line which is electrically connected to the plurality of second covering portions and which extends in a direction of the second heat resistor array;

a third common line which is electrically connected to the first and second common lines;

the first covering portions being insulated from the heat resistors covered by the first covering portions, and the second covering portions being insulated from the heat resistors covered by the second covering portions, a first fuse portion which connects an end portion of the first common line in the direction of the first heat resistor array to the third common line; and a second fuse portion which connects an end portion of the second common line in the direction of the second heat resistor array to the third common line; and a member having discharge ports which discharge liquid and which are disposed so as to correspond to the heat resistors.

5. A method for disconnecting a fuse portion in a liquid discharge head substrate, the liquid discharge head substrate includes:

a first heat resistor array having a plurality of heat resistors including a first heat resistor and a second heat resistor;

a second heat resistor array including a plurality of heat resistors which are arranged along the first heat resistor array;

a plurality of first covering portions which have conductivity and which cover the respective heat resistors included in the first heat resistor array;

a plurality of second covering portions which have conductivity and which cover the respective heat resistors included in the second heat resistor array;

a first common line which is electrically connected to the plurality of first covering portions;

a second common line which is electrically connected to the plurality of second covering portions;

a third common line which is electrically connected to the first and second common lines;

a first fuse portion which connects the first common line and the third common line to each other; and a second fuse portion which connects the second common line and the third common line to each other, wherein the first covering portions are insulated from the heat resistors covered by the first covering portions, the second covering portions are insulated from the heat resistors covered by the second covering portions, and a first covering portion which covers the second heat resistor has lower electric resistance to the first fuse portion when compared with a first covering portion which covers the first heat resistor, the method comprising:

when the first heat resistor is electrically connected to the first covering portion which covers the first heat resistor, applying a voltage to the second heat resistor and the second heat resistor is electrically connected to the first covering portion which covers the second heat resistor so that the first fuse portion is disconnected.

6. A method for disconnecting a fuse portion in the liquid discharge head substrate according to claim 5, wherein voltage is applied to the second heat resistor which is covered by one of the first covering portions which has smallest electric resistance to the first fuse portion so that the first fuse portion is disconnected.

7. A method for disconnecting a fuse portion in the liquid discharge head substrate according to claim 5, wherein the first common line extends in the direction of the first heat resistor array, wherein the first fuse portion connects an end portion of the first common line in the direction of the first heat resistor array to the third common line, and wherein voltage is applied to the second heat resistor which is positioned in an end portion of the first heat resistor array near the end portion of the first common line so that the first fuse portion is disconnected.

8. The method for disconnecting a fuse portion in the liquid discharge head substrate according to claim 5, wherein energy larger than energy applied to the second heat resistor when liquid is discharged in normal printing is applied to the second heat resistor by applying voltage to the second heat resistor so that the first fuse portion is disconnected.

9. The method for disconnecting a fuse portion in the liquid discharge head substrate according to claim 8, wherein energy which is at least one-and-a-half times as large as energy applied to the second heat resistor when liquid is discharged in the normal printing is applied to the second heat resistor by applying voltage to the second heat resistor so that the first fuse portion is disconnected.

10. The method for disconnecting a fuse portion in the liquid discharge head substrate according to claim 5, wherein, in a case where a state in which the first heat resistor is electrically connected to the first covering portion which covers the first heat resistor is detected and a state in which the first fuse portion is not disconnected is detected, voltage is applied to the second heat resistor so that the first fuse portion is disconnected.

* * * * *